US011933565B2

(12) United States Patent
Kart

(10) Patent No.: US 11,933,565 B2
(45) **Date of Patent: *Mar. 19, 2024**

(54) FIREARM BARREL AND METHOD OF IMPROVING PROJECTILE WEAPON ACCURACY, VELOCITY AND DURABILITY

(71) Applicant: Frederick H. Kart, Shallotte, NC (US)

(72) Inventor: Frederick H. Kart, Shallotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/049,813

(22) Filed: Oct. 26, 2022

(65) Prior Publication Data

US 2023/0228512 A1 Jul. 20, 2023

Related U.S. Application Data

(63) Continuation of application No. 17/496,340, filed on Oct. 7, 2021, now Pat. No. 11,493,296.

(51) Int. Cl.
*F41A 21/18* (2006.01)

(52) U.S. Cl.
CPC ..... *F41A 21/18* (2013.01)

(58) Field of Classification Search
CPC ..... F41A 21/18
USPC ..... 42/78; 89/14.7
See application file for complete search history.

(56) References Cited

U.S. PATENT DOCUMENTS 245,015 A 8/1881 Reilly
1,355,421 A * 10/1920 Pedersen ..... F41A 21/18 42/78
1,944,883 A * 1/1934 Gerlich ..... F41A 21/16 89/14.05
2,345,089 A 3/1944 Woldemar
3,566,528 A * 3/1971 Walton ..... F42B 10/10 42/76.01
11,493,266 B2 * 11/2022 Kart ..... F41A 21/18
2002/0007580 A1 * 1/2002 Randall ..... F42B 35/00 42/76.01
2012/0117846 A1 * 5/2012 Carlock ..... F41A 21/12 42/78
2015/0007479 A1 1/2015 Kunau

FOREIGN PATENT DOCUMENTS

EP 0438870 A1 7/1991
WO 2011012766 2/2011

OTHER PUBLICATIONS

Extended European Search Report dated Feb. 9, 2023, for EP Application No. 22199676, 8 pgs.

* cited by examiner

*Primary Examiner* — Bret Hayes
(74) *Attorney, Agent, or Firm* — Shumaker, Loop & Kendrick, LLP; S. Alexander Long, Jr.

(57) ABSTRACT

A firearm barrel, including rifling formed of an alternating, spirally-extending plurality of grooves and lands defining a twist angle adapted for imparting rotation to a bullet being impelled through the barrel from a chamber end to and exiting a muzzle end. The plurality of lands each include a reduced width component communicating with the chamber end of the barrel for a predetermined distance towards the muzzle end of the barrel. The reduced width component defines an acute angle in relation to a longitudinal axis of the barrel adapted to cause a bullet being fired from the firearm to prevent blow-by gases to exit the barrel in advance of the bullet. A method of forming the firearm and barrel is also disclosed.

17 Claims, 4 Drawing Sheets

FIREARM BARREL AND METHOD OF IMPROVING PROJECTILE WEAPON ACCURACY, VELOCITY AND DURABILITY

CROSS REFERENCE TO RELATED PATENT APPLICATION

This application is a continuation application tracing priority to United States Application having Ser. No. 17/496,340 filed on Oct. 7, 2021. This Application accordingly claims full benefit and priority to that application.

TECHNICAL FIELD AND BACKGROUND OF THE INVENTION

This invention relates to projectile weapon accuracy and wear prevention. The invention has broad application to any firearm such as a pistol, rifle, machine gun or other projectile weapon, including artillery, and nothing in the following discussion is meant to imply otherwise. The description of the invention with reference to a U.S. caliber 45 model 1911 pistol as made by Colt, Remington, Ithaca Gun Company and others is for the purpose of providing an enabling embodiment of the invention and for no other reason. The purpose of this innovation is to prolong the life of the barrel, minimize metal fouling of the bore, increase the velocity and accuracy of the projectile and reduce recoil of the firearm. A standard 45 caliber Colt, when properly adjusted with no worn or damaged parts and when bench fired, is capable of hitting a target at 50 feet with a spread of approximately 6 inches (15 cm).

The continuing popularity and availability of these pistols has resulted in their use for sport target competition, and as weapons for special military and police units where enhanced accuracy is necessary or desirable. It has been observed that are five factors are principally responsible for inherent design inaccuracy in a 45 caliber pistol—the fit of the slide to the frame, the fit of the barrel hood of the barrel into the shell ejection opening, the fit of the aft barrel locking groove onto the aft slide locking wall segment, the fit of the link and link lug to the slide stop pin, and the design of the grooves and lands formed into the barrel to provide a stabilizing rotational motion to the projectile as it travels down the barrel. This application addresses the last of the above-mentioned design features, particularly the design and configuration of the grooves and lands forward of the front of the pistol chamber, with the result that significantly greater accuracy and velocity can be obtained while reducing erosion and abrasion in the barrel caused by gas blow-by. Abrasion can be caused by gas blow-by, which carries unburned powder as well as ash. This material can abrade the lands and grooves of the barrel as a bullet passes over these accumulations to the point where the barrel loses accuracy.

The most common form of rifling comprises six (6) spirally formed lands and grooves, with the groove width being approximately two times as wide as the land width, in this case the groove widths being 0.160 inch and the land widths being 0.080 inch, a two to one ratio. Each land is 0.004 inch high. While the twist rate for rifled weapons varies, twist rates in the range of 1 in 10 (1 360° rotation of the bullet in 10 inches) to 1 in 20 is common, the typical twist rate for the standard 45 caliber Colt barrel being 1 in 16. While dimensions vary, a barrel of a typical U.S. caliber 45 model 1911 pistol will have an internal diameter at the grooves of 0.452 inch and a length of between 3.5 and 5 inches.

This application relates to a process to improve both accuracy and muzzle velocity (and hence power) of weapon barrels generally, such as artillery, machine guns, pistols, revolvers and, by way of example for purposes of this application, 45 automatic barrels. The application also includes a disclosure of gun barrels and weapons that include features of the process disclosed in this application. In conventional rifled barrels, the bullet enters the barrel from the cartridge without any rotational component of movement. The bullet enters the barrel and the alternating lands and grooves impart spin, thus stabilizing the movement of the bullet after exiting the barrel. However, the bullet does not spin instantaneously upon entering the barrel. Rather, a first component of movement into the barrel is a continued non-rotational movement until its non-rotational inertia is overcome and the bullet starts to spin.

The bearing surface of the bullet, that which has direct contact with the lands and grooves of the barrel, is normally approximately 0.315 inch in length and is set within the mouth of the cartridge case. This dimension is held throughout the varying bullet weights, which range from 185 grains to 230 grains, in order to maintain the proper volume of the combustion chamber for proper ignition of the powder charge. This supported portion of the bullets weigh 125 grains, leaving 60 grains or 33 percent of the 185 grain bullet unsupported by rifling and 105 grains or 45 percent of the 230 grain bullet unsupported by rifling.

It is common practice to choose a bullet diameter to match the diameter of the groove of the barrel of the firearm. When a bullet is fired into conventional rifling, it will encounter six 0.080 inch wide by 0.004 inch high spirally formed rifling lands. These six lands must be impressed into the bullet for it to pass into the barrel. It is known that metal is not compressible, so in order for the bullet to pass into the barrel, the bullet must change its shape. Three factors affect the manner in which the bullet performs. The bullet must deform to accept the rifling lands, and the rear of the bullet, that initially has an unsupported diameter, will have been expanded in diameter by the explosive force driving it and must be forced back to the size of the rifling grove to allow the bullet to pass into the barrel bore and pass through it. The only way this can happen is for the bullet to extrude itself in length so it will not burst the barrel. All of these forces will have a negative effect on the concentricity and integrity of the bullet and on accuracy when the bullet is propelled through the barrel and to its target. The instantaneous deformation, reformation and extrusion into the unsupported nose portion of the bullet may result in loss of symmetry of the bullet and, accordingly, loss of power and accuracy.

When the cartridge is fired, the bullet travels in a straightforward and non-rotational manner until the bearing surface of the bullet has advanced 0.350 inch from the front edge of the chamber into the spirally formed rifling. At this point, the bearing surface of the bullet has become fully engaged with the spiral leading surfaces of the rifling lands. The barrel will have imparted enough force on the bullet to overcome inertia of the bullet and cause the bullet to begin to rotate, gradually at first, then progressing more rapidly as more and more of the rifling imparts more and more force until the bullet attains full rotational speed at a further distance of 0.200 inch. These are average distances taken from a series of actual shots fired with abrasive coated bullets, and their resulting abrasions being measured with a 40× measuring microscope.

During this combined forward movement of approximately 0.550 inch, the 0.315 inch long bearing surface of the bullets and its increasingly rotational movement against the leading edge of the spirally shaped rifling lands leaves voids in the bearing surface of the bullet at the rear of each of the six rifling lands. These voids momentarily allow a "blow-by" of combustion gases past the bullet and down the barrel until full rotation of the bullet is attained. This "blow-by" is evidenced by a puff of combustion gases that exits the barrel in advance of the bullet. These escaping gases can cause erosion at the end of the chamber and lead into the throat of the rifling where the bullet must be constricted to the size of the groove. Under sustained fire, as with a machine gun, this erosion can be so extensive as to make the barrel unusable. These escaping gases carry unburned powder and powder ash ahead of the bullet, and interaction between the bullet and the ash can cause the ash to act as an abrasive, scoring and thus damaging the barrel bore. Closure of these voids will take place as full width rifling is impressed into the bullet's bearing surface and full rotational speed is attained. The scraping and subsequent reforming of the bullet's surface allows raw and unlubricated metal to contact and adhere to the barrel surface, resulting in metal fouling of the bore.

The instantaneous contact of the rifling's restricted bore, the forcing of the rifling into the surface of the bullet, the restriction of the expanded bullet base and of the extrusion and lengthening of the bullet forces any extruded material forward into the unsupported portion of the bullet. The intense pressure will force the unsupported bullet nose to expand at its weakest point, making an off-center bulge or bend in the nose asymmetric to the base. This is demonstrated by the fact that hollow point bullets are known to shoot more accurately than closed nose bullets. This is because the hollow point allows the extruded material of the lead core space to expand, and the resulting inward deformation of the bullet's nose forces the extruded material of the lead core toward the centerline of the bullet, thus minimizing but not necessarily eliminating any imbalance that may have occurred.

The manner of operation of the Colt 45 semi-automatic pistol is well-known in the art. In general this weapon is a delayed blowback type, wherein during firing the blowback pressure exerted by the cartridge shell on the bolt face of the slide is used to operate the slide, during the course of which the slide is unlocked for movement relative to the barrel, the spent shell ejected, the hammer cocked, a new cartridge brought to the firing chamber, and the slide returned to locked firing position.

During firing the barrel is locked against movement by the cooperation of the locking wall segments of the slide and the locking grooves of the barrel to allow the slide to continue to the rear to expel the spent cartridge case. During shell ejection and shell loading, the barrel is unlocked from the locking wall segments and pivots downwardly allow the slide to continue to the rear, eject the cartridge case and then move forward to receive the next cartridge from the magazine.

According to the invention of this application, it has been determined that removing material from the lands of the barrel near the entrance point of the chamber avoids blow-by of gases exiting the barrel in advance of the bullet. This feature thus improves both accuracy and power of a weapon with a barrel so modified. The angle of the land is changed to have two components—a first component at the barrel entrance that has an angle that is parallel with the longitudinal axis of the barrel, and a second component that transitions from the angle of the first component to the angle of the land. The material is removed on the side of the land opposite the direction of the angle of the rifling and prevents or substantially reduces blow-by, lateral barrel deflection and recoil, and increases muzzle velocity.

Importantly, preventing blow-by reduces the abrasive effect of the gases and powder ash on the interior of the weapon barrel that over time can damage the barrel throat and barrel bore. This erosion, or "gas etching", is presently a serious problem in many types of projectile weapons.

Importantly, the geometry of the barrel according to the invention of this application results in the bullet being centered in the bore of the barrel at an earlier point in the firing process, leading to greater accuracy and less wear on the lands and grooves.

The advantages discussed in this application result in a substantial reduction in gas etching and abrasion of the barrel interior and substantially increases the life of the barrel.

U.S. Pat. No. 245,015 to H. Reilly ("Reilly") discloses a cannon barrel that has a series of variations in land and groove width along the length of the barrel, at points a, b, c, d and e:

Reilly contains no details or specifications regarding how the invention is practiced. In fact, the inventor states merely that:

> The distance to which this beveling should extend from the breech toward the muzzle and the amount of the lands to be cut away cannot be given for all guns, because it will vary in guns of different size, in rifling of different pitch, and with shot of different weight . . . . This can only be ascertained by experimenting with the shot and gun in which the invention is to be used. Reilly, lines 49-59.

Thus, Reilly does nothing more than invite experimentation. This is insufficient as an enabling disclosure of an invention. Moreover, Reilly does not actually show any discernable enlargement of the grooves or reduction of the lands. Finally, even if there were any discernable enlargement of the grooves or reduction in the lands, any enlargement in the grooves, Reilly states that he reduces the lands "on that side of the lands against which the expanded portion of the sabot presses by reason of the twist of the rifling." Id. at 92-95. Reilly further speculates that doing this "the sabot would probably be torn to pieces if the side of the groove against which it does so press were made at all uneven." Id. at 95-97. Contrary to Reilly, the material must be removed on the side of the land opposite the direction of the angle of the rifling in order to prevent or substantially reduce blow-by, lateral barrel deflection and recoil, and increase muzzle velocity, as described above.

U.S. Pat. No. 2,345,089 ("Born") discloses a gun barrel that transitions from a relatively large initial caliber at the breach to a relatively smaller caliber at the muzzle "in order to increase the propelling force imparted to the bullet." Born, p. 1 at 5-8. FIGS. 1, 1*a* and 2-5 disclose a barrel wherein the barrel is "conical" and the lands extend into the conical part of the barrel. Id. at lines 40-50. As the bullet travels down the barrel, its diameter is decreased. FIG. 1*b* is described as a "modification", Id. at line 48, the modification being that the lands have "a very small twist or without any initial twist, as shown in FIG. 1*b* so as to assume only quite gradually their normal width and height and their final twist." Id. at p. 1, line 54-p. 2, line 3. Born points to reference numeral 23 of FIG. 1*b* as the area "in which the first acceleration an deformation is imparted to the projectile is made without any twist of the rifling . . . ." Id. at p. 2, line 28-2.

This is distinct from the invention of this application for at least three reasons. First, the invention of this application has spiral rifling, i.e., "twist", along the entire length of the barrel. Second, to the extent, if any, that lands and grooves exists in the area of reference numeral 23 of Born, the lands and grooves are symmetrical, whereas in the invention of this application the lands and grooves in the area near the chamber of the firearm are asymmetric. Third, as with Reilly, Born provides absolutely no information regarding dimensions or relationships of any of the relevant elements of the barrel—diameters of the barrel, length, width and height of the grooves and lands, angle of twist, for example. Thus, as with Reilly, the skilled artisan is left to experiment to see if the purported invention has any merit. A reference must provide an enabling disclosure of the desired subject matter; mere naming or description of the subject matter is insufficient, if it cannot be produced without undue experimentation.

SUMMARY OF THE INVENTION

Therefore, it is an object of the invention to provide a method of improving the accuracy and power of any weapon having a rifled barrel.

It is another object of the invention to provide a method of providing a rifled barrel that is adapted to prevent a bullet being fired down the barrel to avoid blow-by of gases exiting the barrel in advance of the bullet.

It is another object of the invention to provide a method of reducing erosion and abrasion in a rifled weapon barrel by reducing gas blow-by during firing.

These and other objects and advantages of the invention are achieved by providing a firearm barrel having a longitudinal axis, including rifling formed of an alternating, spirally-extending plurality of grooves and lands for imparting rotation to a bullet or other projectile being impelled through the barrel from a chamber end to and exiting the muzzle end, the plurality of lands having a reduced width from a position communicating with the chamber end of the barrel for a predetermined distance towards the muzzle end of the barrel for avoiding blow-by of gases exiting the barrel in advance of the bullet.

According to another aspect of the invention, a firearm barrel is provided having a longitudinal axis, including rifling formed of an alternating, spirally-extending plurality of grooves and lands defining a twist angle adapted for imparting rotation to a bullet being impelled through the barrel from the end of the chamber to and exiting the muzzle end, the plurality of lands each including a reduced width component communicating with the end of the chamber of the barrel for a predetermined distance towards the muzzle end of the barrel, the reduced width component defining an acute angle in relation to the longitudinal axis of the barrel.

According to another aspect of the invention, the plurality of lands having a reduced width each define a triangular-shaped area on a side of the lands opposite direction of the angle of the twist.

According to another aspect of the invention, the first angle component is formed by removing material from the barrel on a side of the lands opposite the direction of the angle of the rifling.

According to another aspect of the invention, the twist rate of the barrel is 1 to 16.

According to another aspect of the invention, the reduced width component of the lands provides a 5/1 groove/land ratio for reducing the initial impact of the bullet in the barrel.

According to another aspect of the invention, the barrel includes a 0.125 inch throat, a 0.030 inch space from the end of the chamber of the barrel to the lands; 0.200 inch between lands at a distance of 0.125 inch from the end of the chamber; a land width of 0.040 at 0.125 inch from the end of the chamber and a groove width of 0.200 inch at 0.125 inch from the end of the chamber.

According to another aspect of the invention, the width of the lands is 0.067 inch at 0.350 from the end of the chamber and 0.080 inch at 0.550 inch from the end of the chamber.

According to another aspect of the invention, the lands have a height above the grooves of 0.004 inch.

According to another aspect of the invention, the barrel has an inside diameter at the grooves of 0.452 inch and a length of between 3.5 and 5 inches.

According to another aspect of the invention, a firearm barrel having a longitudinal axis is provided and includes rifling formed of an alternating, spirally-extending plurality of grooves and lands defining a twist angle adapted for imparting rotation to a bullet being impelled through the barrel from a chamber end to and exiting the muzzle end, the plurality of lands each including a reduced width component communicating with the chamber end of the barrel for a predetermined distance towards the muzzle end of the barrel, the reduced width component defining an acute angle in relation to the longitudinal axis of the barrel. The plurality of lands have a reduced width each defining a triangular-shaped area on a side of the lands opposite direction of the angle of the twist. The reduced width component is formed by removing material from the barrel on a side of the lands opposite the direction of the angle of the rifling. The barrel according to the example of this application has a twist rate of 1 to 16 and the reduced width component of the lands providing a 5/1 groove/land ratio for reducing the initial impact of the bullet in the barrel.

According to another aspect of the invention, the firearm barrel includes a 0.125 inch throat, a 0.030 inch space from the end of the chamber to the lands; 0.200 inch between lands at a distance of 0.125 inch from the end of the chamber; a land width of 0.040 at 0.125 inch from the end of the chamber and a groove width of 0.200 inch at 0.125 inch from the end of the chamber.

According to another aspect of the invention, the width of the lands is 0.067 inch at 0.350 from the end of the chamber and 0.080 inch at 0.550 inch from the end of the chamber.

According to another aspect of the invention, the lands have a height above the grooves of 0.004 inch.

According to another aspect of the invention, the barrel has an inside diameter at the grooves of 0.452 inch and a length of between 3.5 and 5 inches.

According to a method aspect of the invention, a method of increasing the accuracy of a firearm barrel is provided that includes the steps of providing a firearm barrel having a longitudinal axis, including rifling formed of an alternating, spirally-extending plurality of grooves and lands defining a twist angle adapted for imparting rotation to a bullet being impelled through the barrel from a chamber end to and exiting the muzzle end, and forming in each of the plurality of lands a reduced width component communicating with the chamber end of the barrel for a predetermined distance towards the muzzle end of the barrel, the reduced width component defining an acute angle in relation to the longitudinal axis of the barrel.

According to another aspect of the invention, the method includes the step of removing material from the barrel on a side of the lands opposite the direction of the angle of the rifling.

According to another aspect of the invention, the method includes the step of providing a 1 to 16 twist rate in the barrel.

According to another aspect of the invention, the method includes the step of forming the groove/land ratio of 5/1 in the reduced width component of the lands ratio for reducing the initial impact of a bullet entering the barrel.

BRIEF DESCRIPTION OF THE DRAWINGS

The present invention is better understood when the following detailed description of the invention is read with reference to the accompanying drawings, in which.

DETAILED DESCRIPTION OF THE INVENTION AND BEST MODE

Figure 1:
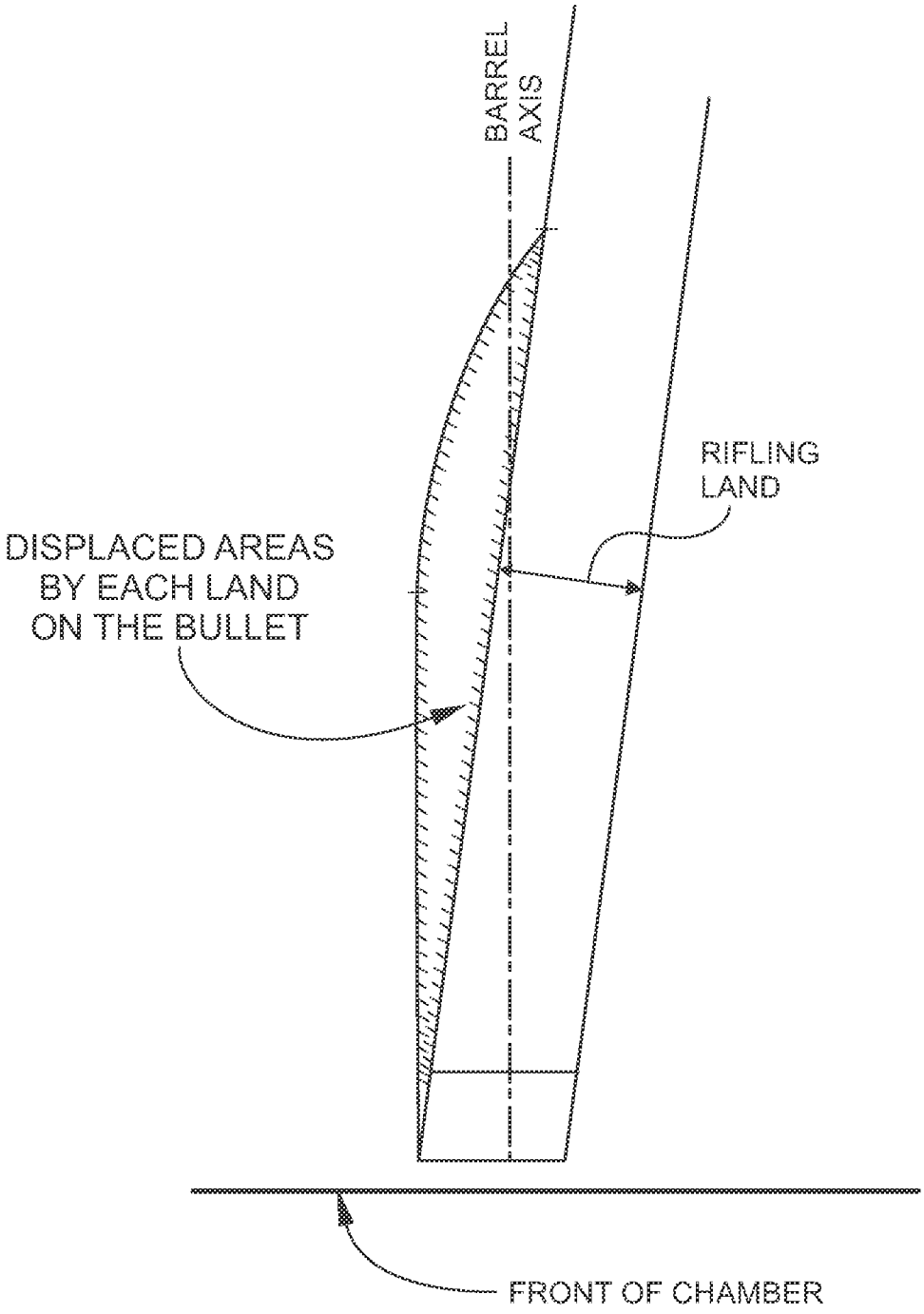
FIG. 1 (Prior Art)
FIG. 1 is a fragmentary plan view of the chamber end of a prior art firearm barrel.

Referring now to the drawings, a fragmentary view of the chamber end of a barrel of a 45 caliber semi-automatic pistol of conventional manufacture is illustrated in FIG. 1 and shown generally by means of a fragmentary plan view illustrating a conventional rifling land that along its entire length extends at an angle, for example, 5 degrees, in relation to the longitudinal axis of the barrel. As noted, bullet rotation does not begin immediately, but proceeds straight into the barrel with the results explained above with reference to conventional, prior art barrel rifling.

When a chambered cartridge is fired, the bullet moves in a straightforward direction with no rotation until the leading edge of the rifling land can exert enough force to start the bullet to rotate. Until the bullet can attain full rotational speed, the surface of the bullet is being displaced, which in turn leaves displaced areas, i.e., "voids", between the displaced surface and the trailing edges of the rifling as shown in FIG. 1. These displaced areas are not closed until the bullet has traveled far enough into the barrel so that the material in the bullet displaced by the rifling is forced back to fully fill the void.

During the time before the void is fully filled by the bullet, a portion of the propelling gases escape through the unclosed void, which is evidenced by a puff of smoke, which exits the muzzle of the barrel ahead of the bullet. When the cartridge is fired, the leading edge of the bullet strikes the full width of the riflings, the explosive force driving it causes the base of bullet to expand in diameter. This causes more deformation of the bullet which must be forced back to the size of the barrel bore in order to pass through.

As bullet diameters are usually matched to the groove diameter of the barrel, the lands of the barrel must be impressed into the bullet. Because metal is not compressible, the bullet must again be deformed so that it will not burst the barrel. The only way for this to be accomplished is for the bullet to extrude lengthwise. The bullet is now being deformed in three dimensions, in the circumferential direction to fill the void, in the lengthwise direction to make room for the rifling land displacement, and in the diametrical direction to swage back the deformed base of the bullet. All of these forces have a negative effect on the integrity and concentricity of the bullet as it existed before firing, compromising accuracy and power.

Figures 2A, 2B:
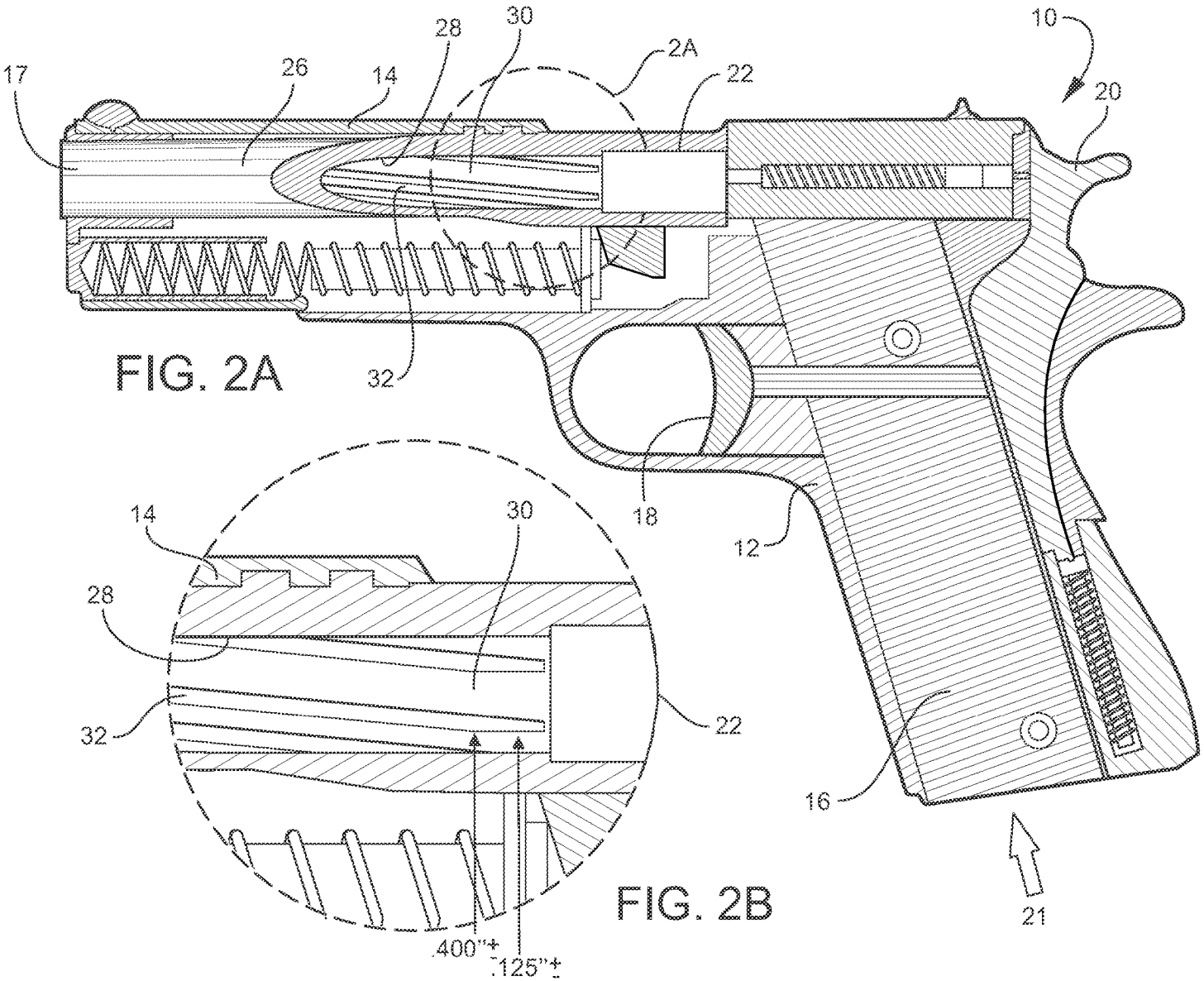
FIG. 2A is a partial vertical-cross section of a 45 automatic pistol.
FIG. 2B is an enlarged view of the chamber and the adjacent segment of the barrel in accordance with a preferred embodiment of the invention.

In contrast, and in accordance with a preferred embodiment of the invention, a pistol is shown at reference numeral 10 in FIG. 2A. Pistol 10 is broadly formed of a receiver 12, slide 14, and barrel 17. The receiver 12 has a grip 16 and carries a trigger mechanism including a trigger 18 and hammer 20. A magazine 21 is positioned in a chamber in the grip 16 and holds cartridges to be fed one-by-one into the firing chamber 22 of the pistol 10.

The barrel 17 is slidable and tiltable relative to the slide 14 and is connected to the receiver 12 through a link pivotally connected to an integrally-formed link lug formed on the barrel 17 by a pin. The barrel 17 is also pivotally connected to the receiver 12 by another pin of a slide stop. Further details may be found by reference to applicant's issued U.S. Pat. No. 5,753,848.

Barrel 17 includes a cylindrical barrel portion 26 having a central bore 28 with rifling grooves 30 separated by raised lands 32. As manufactured, a Colt 45 caliber pistol is relatively inaccurate except at short range. For this reason, Colt 45 caliber pistols intended for competition use are typically "accurized" to increase the accuracy of the pistol.

"Accurization" of a Colt 45 semi-automatic pistol according to prior art techniques includes four basic procedures:

1. properly fitting the slide of the pistol to the frame of the pistol;
2. properly fitting the barrel 17 in the slide;
3. properly fitting the locking grooves of the barrel 17 onto the mating locking wall segments of the slide 14; and
4. fitting the link lug for proper camming action against the pin of the slide stop.

These procedures are described in applicant's prior U.S. Pat. No. 5,753,848 as noted above. Further accurization can be affected by modifying the configuration of the grooves 30 and lands 32 in accordance with the techniques set out and claimed in this application. Specifically, in accordance with the invention, a significant change is made to the conventional form of rifling by removing material from the sides of the lands opposite to the direction of the angle of the rifling twist. This, according to the aforementioned measurements, shall be in a straight line parallel to the longitudinal axis of the barrel for a distance of 0.350 inch from the end of the chamber, where it will begin to curve toward the leading or driving side of the rifling land. This curve shall continue 0.200 inch gradually at first and then curve more and more as the bullet engages more force from the rifling and where the bullet will attain full rotational speed and meet the trailing edge of the rifling and blend to its full width and rate of twist. See FIG. 2A and FIG. 5. Note particularly that in accordance with the invention both the grooves 30 and the lands 32 are now asymmetric along the first 0.320 inch of the barrel length.

Figure 5:
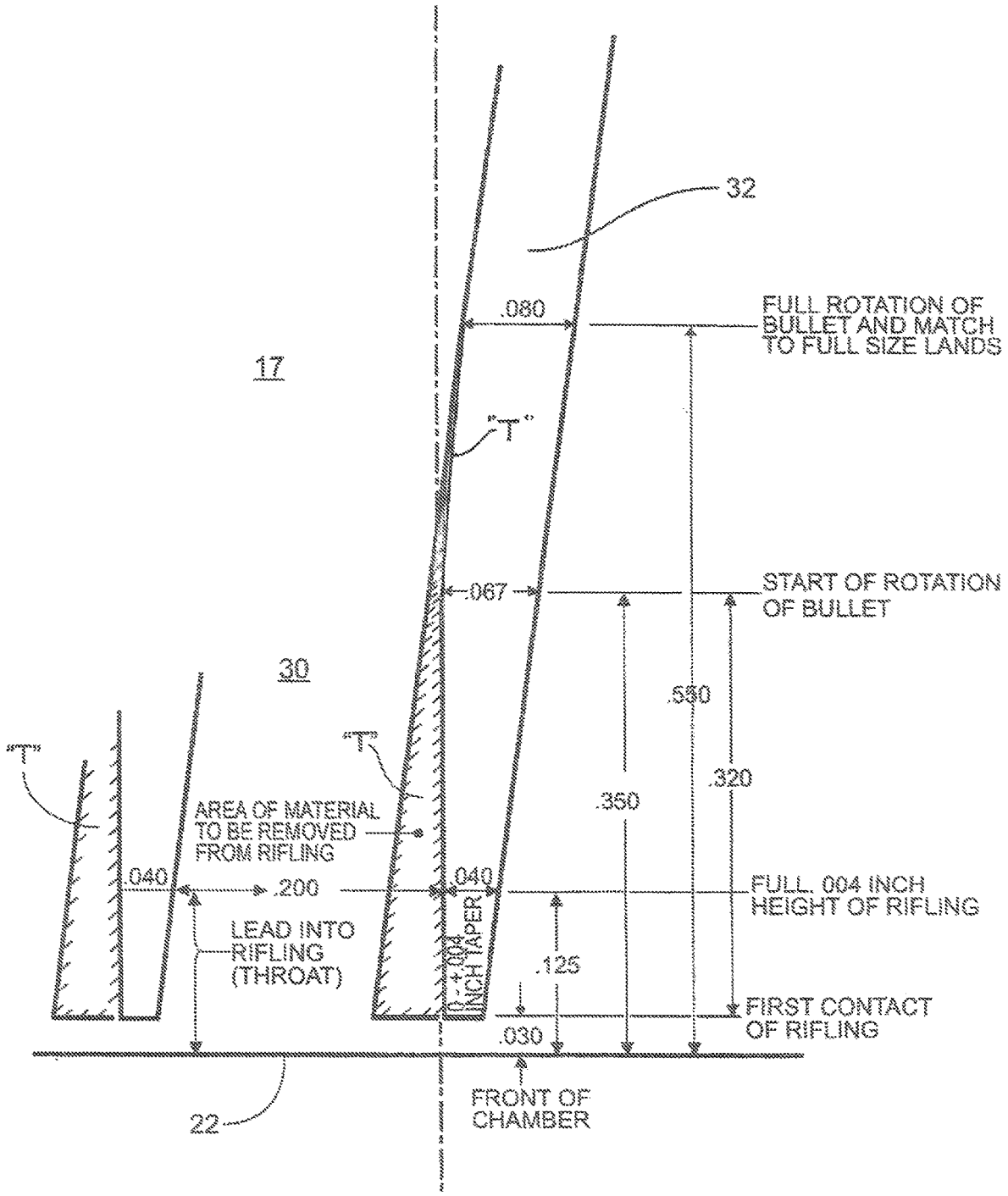
FIG. 5 is a fragmentary side view with parts broken away of an automatic pistol showing the portion of the pistol barrel, in cross-section, adapted to an embodiment of the present invention.

As best shown in FIG. 5, this is accomplished by eliminating a triangularly-shaped area "T" from the lands 32 adjacent the end of the lands 32 and grooves 30. This asymmetry is critical to the improved functioning of the barrel of the 45 caliber semi-automatic pistol described in this application and is a distinctive departure from the prior art. As previously noted, this principle is equally applicable to any rifled barrel used to launch a projectile, be it a bullet, sabot, shell or other projectile.

Figure 3:
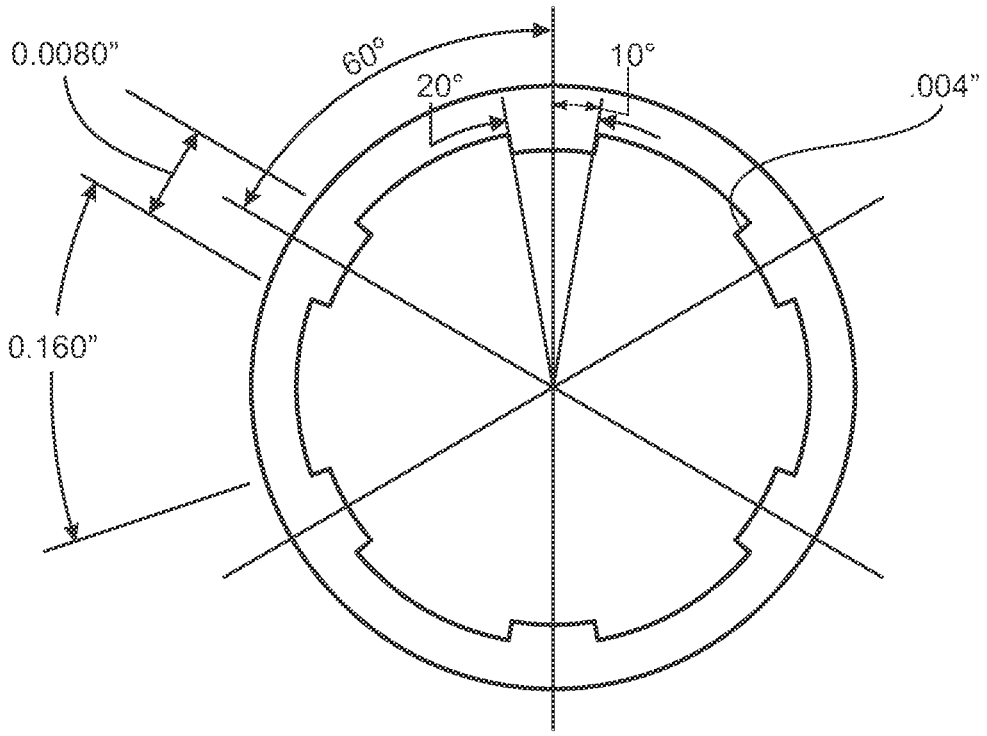
FIG. 3 is a radial cross-section of a conventional 45 automatic pistol barrel 0.125 inch from the end of the chamber of the barrel.

As shown in FIG. 3, the width of the lands of a conventional 45 caliber pistol barrel is 0.080 inch and the width of the grooves is 0.160 inch, resulting in a 2/1 groove/land ratio.

Figure 4:
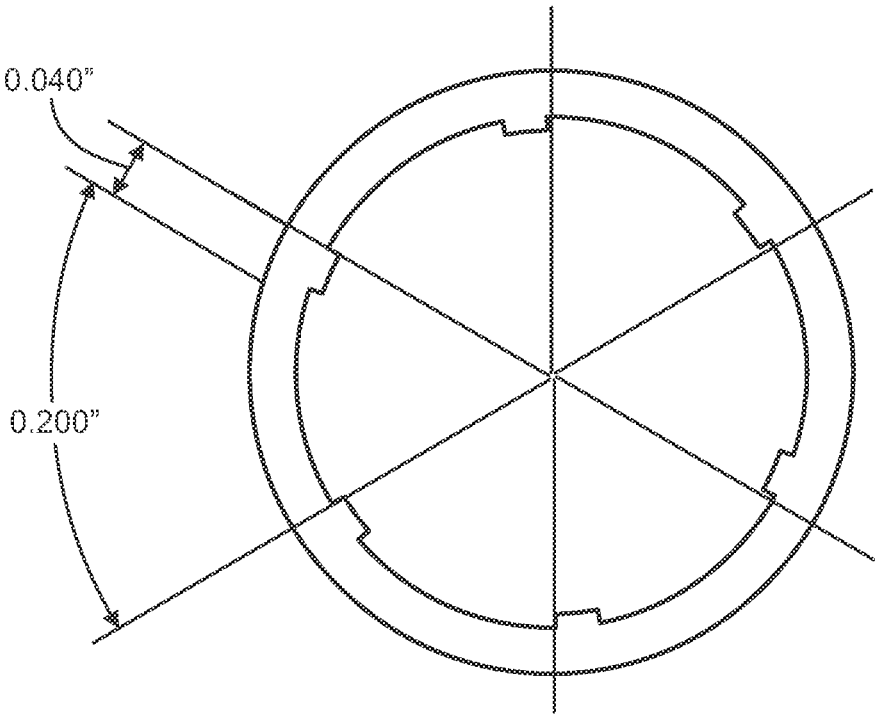
FIG. 4 is a radial cross-section at the chamber end of a 45 automatic pistol barrel at a distance of 0.125 inch from the end of the chamber in accordance with a preferred embodiment of the invention.

As shown in FIG. 4, when the material is removed from the trailing edge of the rifling as described above, the initial width of the rifling lands is 0.040 inch, cutting the first encounter of the bullet with the barrel by 50 percent. The grooves are 0.200 inch, resulting in a 5/1 groove/land ratio, substantially reducing the initial impact of the bullet in the barrel. As the bullet enters the rifling, the portion of the prior art rifling that scraped and left a void in the bullet will no longer be there. Instead, one side of the back edge of the rifling will be straight, parallel with the centerline axis of the barrel and no void will be formed on the bullet. An absolute minimum of combustion gases will escape past the bullet, allowing the gases to remain behind the bullet to propel the bullet at a higher velocity. With virtually no gas escaping past the bullet, erosion at the end of the chamber is minimized, no burned or unburned powder and ash can precede the bullet down the bore to abrade and score the barrels surface. The scraping and reforming of the bullets surface no longer happens. All surfaces of the bullet will maintain their lubrication and metal fouling of the bore will be minimized or nonexistent. The instantaneous contact of the rifling restricted bore will not be as violent. The width of the lands will allow easier entry into the bore, resulting in less expansion of the base of the bullet, hence easier reforming to groove size. With the straight line back of the lands the entry of the bullet into the bore will allow a longer moment for the extrusion in length to take place. All of the above have an effect on the concentricity and integrity of the bullet. All of these factors will enhance the accuracy of a fired round.

In addition, preventing blow-by reduces the abrasive effect of the gases on the interior of the weapon barrel that over time can damage the barrel throat and bore. In addition to enhancing accuracy and providing the other advantages discussed in this application, the substantial reduction in gas etching and abrasion of the barrel interior substantially increases the life of the barrel.

It has been determined that removing material from the lands 32 of the barrel 17 near the entrance point of the chamber 22 allows the bullet to prevent the escape of blow-by gases from the barrel in advance of the bullet. This improves accuracy, power and substantially lengthens the useful life of the barrel. The angle of the lands 32 is changed to have two components—a first component at the chamber end of the barrel that has an angle that is parallel with the longitudinal axis of the barrel, and a second component that transitions from the angle of the first component to the angle of the lands 32, resulting in the asymmetry described above.

As best shown in FIG. 5, the triangular material "T" barrel material is eliminated on the side of the lands 32 opposite the direction of the angle of the rifling and prevents or substantially reduces blow-by, lateral barrel deflection, recoil, increases muzzle velocity and provides increased barrel life. Each different loading of powder, the rifling, the different texture of the bullet and the type of firearm will change the design of the following edge of the rifling. According to the exemplary embodiment of this application, a 0.030 inch gap between the front of the chamber 22 and the beginning of the lands 32 provides an area where the bullet is centered before the bullet fully enters the barrel 17. This provides a more geometrically-cylindrical bullet resulting in greater accuracy and less wear on the barrel 17, particularly the lands 32.

One embodiment of the invention is explained by way of example by reference in FIGS. 2A and 2B to a Colt 45 semi-automatic pistol with a 5 inch barrel. The barrel 17 rifling preferably has six 5 degree lands 32 having a left or right hand twist of one turn in 16 inches. The first component at the barrel 17 entrance at the transition point adjacent the chamber 22 is 0.350 inches long and, as noted above, is parallel to the longitudinal axis of the barrel 17. The second component defines a transition between the first component and the lands 30 in their conventional progression along the length of the barrel 17 to the muzzle end. The transition according to this embodiment of the invention is 0.200 inches long, the total length of the first and second components thus being 0.550 inches. The second component is curved, preferably progressively curved in the manner of a French curve to intersect and merge into the conventional spiral of the grooves 30 and lands 32 that extend the remainder of the length of the barrel 17 to the muzzle.

Therefore, the bullet initially engages narrower rifling lands 32 causing less initial impact, thus reducing recoil as well as bullet base expansion. The bullet more rapidly fully seals the lands 32 and the grooves 30 of the bore 28 at all times, thereby reducing or eliminating blow-by of propellant gases. Instead, the full force of the gases is exerted against the rear of the bullet resulting in an increase in bullet velocity.

The surface of the bullet where material in conventional barrels is displaced is "raw" and unlubricated. As this material is forced back into contact with the land 32 and groove 30 surfaces, these surfaces are prone to metal fouling and consequent loss of accuracy. In contrast, the barrel arrangement according to the present invention causes the lands 32 to be impressed into the bullet over a longer moment, allowing the bullet to elongate more gradually and consistently, thus minimizing eccentric deformation and maintaining the desired concentricity of the bullet.

Also, by not allowing superheated propellant gases and abrasive powder ash to escape past the bullet, the bore 28 of the barrel 26 will remain cleaner and unabraded longer. Gas etching and abrasion of the barrel and barrel throat is minimized, further extending barrel life. Less deformation and reformation of the bullet in diameter and length will amount to a major reduction in chamber pressure and thus provide a safer firearm.

While the normal barrel muzzle velocity of a 45 caliber bullet is approximately 750-790 feet/second, it is anticipated that the barrel exit speed of a 45 caliber bullet fired through the barrel 28 according to the invention of this application will be approximately 825-850 feet/second—a significant improvement in performance without any modification to the cartridge being fired. While the invention has been disclosed and explained with reference to a 45 caliber semiautomatic pistol, the invention has application to any weapon from which a bullet or similar projectile is fired through a rifled barrel, including revolver-type pistols, manual-load, semiautomatic and automatic rifles, both magazine and belt-fed and artillery.

While a firearm and weapon barrel according to the invention have been described with reference to specific embodiments and examples, it is envisioned that various details of the invention may be changed without departing from the scope of the invention. Furthermore, the foregoing description of the preferred embodiments of the invention and best mode for practicing the invention are provided for the purpose of illustration only and not for the purpose of limitation.

What is claimed is:

1. A method of improving accuracy of a firearm comprising the steps of:

providing a firearm barrel having a longitudinal axis, including rifling formed of an alternating, spirally-extending plurality of grooves and lands defining a twist angle adapted for imparting rotation to a bullet being impelled through the barrel from a chamber end and exiting a muzzle end;

forming in each of the plurality of lands a reduced width component communicating with the chamber end of the barrel for a predetermined distance towards the muzzle end of the barrel, wherein the reduced width component defines an acute angle in relation to the longitudinal axis of the barrel; and preventing blow-by gasses from exiting the barrel in advance of the bullet via the reduced width component, wherein the reduced width component of the lands provides a 5 to 1 groove to land ratio.

2. The method of improving accuracy of a firearm of claim 1 further comprising the step of defining a triangular-shaped area on a side of the lands that is opposite a direction of the twist angle.

3. The method of improving accuracy of a firearm of claim 1 further comprising the step of forming the reduced width component by removing material from the barrel on a side of the lands that is opposite a direction of the twist angle.

4. A method of reducing recoil of a firearm comprising the steps of:

providing a firearm barrel having a longitudinal axis, including rifling formed of an alternating, spirally-extending plurality of grooves and lands defining a twist angle adapted for imparting rotation to a bullet being impelled through the barrel from a chamber end and exiting a muzzle end;

forming in each of the plurality of lands a reduced width component communicating with the chamber end of the barrel for a predetermined distance towards the muzzle end of the barrel to narrow the lands at ends thereof nearest the chamber end such that the bullet initially engages the narrowed lands causing less initial impact thus reducing recoil, wherein the reduced width component defines an acute angle in relation to the longitudinal axis of the barrel; and reducing blow-by of propellant gasses from exiting the barrel in advance of the bullet via the reduced width component, wherein the reduced width component of the lands provides a 5 to 1 groove to land ratio.

5. The method of reducing recoil of a firearm of claim 4 further comprising the step of defining a triangular-shaped area on a side of the lands that is opposite a direction of the twist angle.

6. The method of reducing recoil of a firearm of claim 4 further comprising the step of forming the reduced width component by removing material from the barrel on a side of the lands that is opposite a direction of the twist angle.

7. A method of increasing muzzle velocity of a firearm comprising the steps of:

providing a firearm barrel having a longitudinal axis, including rifling formed of an alternating, spirally-extending plurality of grooves and lands defining a twist angle adapted for imparting rotation to a bullet being impelled through the barrel from a chamber end and exiting a muzzle end;

forming in each of the plurality of lands a reduced width component communicating with the chamber end of the barrel for a predetermined distance towards the muzzle end of the barrel, wherein the reduced width component defines an acute angle in relation to the longitudinal axis of the barrel; and preventing combustion gas from exiting the barrel in advance of the bullet via the reduced width component such that a full force of the combustion gas is exerted against a rear of the bullet thereby increasing muzzle velocity, wherein the reduced width component of the lands provides a 5 to 1 groove to land ratio.

8. The method of increasing muzzle velocity of a firearm of claim 7 further comprising the step of defining a triangular-shaped area on a side of the lands that is opposite a direction of the twist angle.

9. The method of increasing muzzle velocity of a firearm of claim 7 further comprising the step of forming the reduced width component by removing material from the barrel on a side of the lands that is opposite a direction of the twist angle.

10. A method of reducing lateral barrel deflection of a firearm comprising the steps of:

providing a firearm barrel having a longitudinal axis, including rifling formed of an alternating, spirally-extending plurality of grooves and lands defining a twist angle adapted for imparting rotation to a bullet being impelled through the barrel from a chamber end and exiting a muzzle end;

forming in each of the plurality of lands a reduced width component communicating with the chamber end of the barrel for a predetermined distance towards the muzzle end of the barrel, wherein the reduced width component defines an acute angle in relation to the longitudinal axis of the barrel and a triangular-shaped area on a side of the lands that is opposite a direction of the twist angle thereby reducing lateral barrel deflection;

preventing blow-by gasses from exiting the barrel in advance of the bullet via the reduced width component, wherein the reduced width component of the lands provides a 5 to 1 groove to land ratio.

11. The method of reducing lateral barrel deflection of a firearm of claim 10 further comprising the step of forming the reduced width component by removing material from the barrel on a side of the lands that is opposite a direction of the twist angle.

12. A method of reducing chamber pressure in a firearm and improving a bullet's access to a barrel of the firearm comprising the steps of:

providing a firearm barrel having a longitudinal axis, including rifling formed of an alternating, spirally-extending plurality of grooves and lands defining a twist angle adapted for imparting rotation to a bullet being impelled through the barrel from a chamber end and exiting a muzzle end;

forming in each of the plurality of lands a reduced width component communicating with the chamber end of the barrel for a predetermined distance towards the muzzle end of the barrel, wherein the reduced width component defines an acute angle in relation to the longitudinal axis of the barrel such that deformation of the bullet is minimized thereby minimizing chamber pressure; and preventing heated propellant gases from escaping past the bullet via the reduced width component, wherein the reduced width component of the lands provides a 5 to 1 groove to land ratio.

13. The method of reducing chamber pressure in a firearm and improving a bullet's access to a barrel of the firearm of claim 12 further comprising the step of defining a triangular-shaped area on a side of the lands that is opposite a direction of the twist angle.

14. The method of reducing chamber pressure in a firearm and improving a bullet's access to a barrel of the firearm of claim 12 further comprising the step of forming the reduced width component by removing material from the barrel on a side of the lands that is opposite a direction of the twist angle.

15. A method of reducing erosion and abrasion in a firearm comprising the steps of:

providing a firearm barrel having a longitudinal axis, including rifling formed of an alternating, spirally-extending plurality of grooves and lands defining a twist angle adapted for imparting rotation to a bullet being impelled through the barrel from a chamber end and exiting a muzzle end;

forming in each of the plurality of lands a reduced width component communicating with the chamber end of the barrel for a predetermined distance towards the muzzle end of the barrel, wherein the reduced width component defines an acute angle in relation to the longitudinal axis of the barrel; and preventing blow-by gasses comprising at least one of unburned powder and ash from preceding the bullet along the barrel via the reduced width component thereby minimizing erosion and abrasion in the barrel, wherein the reduced width component of the lands provides a 5 to 1 groove to land ratio.

16. The method of reducing erosion and abrasion in a firearm of claim 15 further comprising the step of defining a triangular-shaped area on a side of the lands that is opposite a direction of the twist angle.

17. The method of reducing erosion and abrasion in a firearm of claim 15 further comprising the step of forming the reduced width component by removing material from the barrel on a side of the lands that is opposite a direction of the twist angle.

* * * * *